US009933713B2

(12) United States Patent
Uchida

(10) Patent No.: US 9,933,713 B2
(45) Date of Patent: Apr. 3, 2018

(54) ELECTRO-CONDUCTIVE BELT AND ELECTROPHOTOGRAPHIC APPARATUS

(71) Applicant: CANON KABUSHIKI KAISHA, Tokyo (JP)

(72) Inventor: Kouichi Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/729,997

(22) Filed: Jun. 3, 2015

(65) Prior Publication Data

US 2015/0355561 A1 Dec. 10, 2015

(30) Foreign Application Priority Data

Jun. 6, 2014 (JP) ..... 2014-117845

(51) Int. Cl.

| | |
|---|---|
| ***G03G 5/07*** | (2006.01) |
| ***G03G 5/06*** | (2006.01) |
| ***G03G 5/05*** | (2006.01) |
| ***G03G 15/16*** | (2006.01) |

(52) U.S. Cl.

CPC ..... *G03G 5/075* (2013.01); *G03G 5/0503* (2013.01); *G03G 5/062* (2013.01); *G03G 15/162* (2013.01); *G03G 5/051* (2013.01); *G03G 5/0514* (2013.01); *G03G 5/078* (2013.01)

(58) Field of Classification Search

CPC ..... G03G 5/078; G03G 5/051; G03G 5/0514; G03G 5/075; G03G 5/062; G03G 5/0503

See application file for complete search history.

(56) References Cited

U.S. PATENT DOCUMENTS 6,806,989 B2 * 10/2004 Berneth ..... C09K 9/02 252/583

FOREIGN PATENT DOCUMENTS

| | | |
|---|---|---|
| JP | 2013-142878 A | 7/2013 |
| JP | 2013-242389 A | 12/2013 |

OTHER PUBLICATIONS

English language translation JP 2008-191225, Aug. 2008.*

* cited by examiner

*Primary Examiner* — Margaret G Moore
(74) *Attorney, Agent, or Firm* — Canon USA, Inc., IP Division

(57) ABSTRACT

Provided is an electro-conductive belt including an electro-conductive resin layer. The electro-conductive resin layer includes a matrix containing a thermoplastic resin having at least one bond selected from the group consisting of an amide bond, an ester bond and a carbonate bond, a domain containing an ionic liquid containing a hexafluorophosphate anion or an anion expressed by formula (1), and particles containing a silicone resin having a structure expressed by formula (2): $R_0$—$SiO_{3/2}$. Formula (1)

(1)

8 Claims, 1 Drawing Sheet

ELECTRO-CONDUCTIVE BELT AND ELECTROPHOTOGRAPHIC APPARATUS

BACKGROUND OF THE INVENTION

Field of the Invention

The present application relates to electro-conductive belts, and particularly to an electro-conductive belt used as, for example, an intermediate transfer belt of an electrophotographic apparatus. The present application also relates to an electrophotographic apparatus.

Description of the Related Art

An electro-conductive belt used as the intermediate transfer belt or the like of an electrophotographic apparatus functions to transfer a charged toner from a photosensitive member to a recording medium such as paper, and is therefore electrically conductive. Accordingly, an electro-conductive belt including an electro-conductive resin layer is used. Such an electro-conductive resin layer is made of a hydrophilic thermoplastic resin having an ester bond, a carbonate bond or an amide bond, such as polyester, polycarbonate, or polyamide (Japanese Patent Laid-Open No. 2013-142878). The electro-conductive resin layer may contain an ionic conducting agent, such as an ionic liquid, as a conducting agent (Japanese Patent Laid-Open No. 2013-242389).

SUMMARY OF THE INVENTION

One aspect of the present application is directed to providing an electro-conductive belt having an electrical resistance that is less dependent on environment and that does not vary much even if a transfer electric field is applied thereto. Another aspect of the present application is directed to providing an electrophotographic apparatus that can stably form high-quality electrophotographic images.

According to an aspect of the application, there is provided an electro-conductive belt including an electro-conductive resin layer. The electro-conductive resin layer includes a matrix containing a thermoplastic resin having at least one bond selected from the group consisting of an amide bond, an ester bond and a carbonate bond, a domain containing an ionic liquid containing a hexafluorophosphate anion or an anion expressed by the following formula (1):

(1)

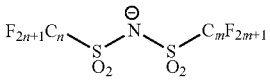

In formula (1), m and n each represents an integer of 1 to 4. The resin composition also contains particles containing a silicone resin having a structure expressed by formula (2): $R_0—SiO_{3/2}$.

In formula (2), $R_0$ represents a hydrocarbon group having a carbon number of 1 to 6.

According to another aspect of the application, an electrophotographic apparatus is provided which includes the electro-conductive belt as an intermediate transfer belt.

Further features of the present application will become apparent from the following description of exemplary embodiments with reference to the attached drawings.

DESCRIPTION OF THE EMBODIMENTS

The present inventors have studied an electro-conductive belt including an electro-conductive resin layer containing a hydrophilic thermoplastic resin having at least one bond selected from the group consisting of an amide bond, an ester bond and a carbonate bond (hereinafter simply referred to as the hydrophilic thermoplastic resin), and an ionic liquid.

The present inventor found through their studies that such an electro-conductive belt including an electro-conductive resin layer made of a composition prepared by adding an ionic liquid to a thermoplastic resin having an ester bond, a carbonate bond or an amide bond changed in electrical resistance depending on the environment (moisture, temperature) in some cases because the ester bond, carbonate bond and amide bond tend to form a hydrogen bond with the water molecule. The changes in electrical resistance depending on the environment may be referred to as environmental dependence of the electrical resistance. An electro-conductive belt having an electrical resistance highly dependent on the environment can cause the quality of the resulting image to vary depending on the use environment.

Accordingly, the present inventors found that an electro-conductive belt including an electro-conductive resin layer made of a composition prepared by adding an ionic liquid containing a hydrophobic anion (hereinafter referred to as hydrophobic ionic liquid) to a thermoplastic resin having an ester bond, a carbonate bond or an amide bond can have an electrical resistance less dependent on the environment.

In the electro-conductive belt formed of a composition prepared by adding a hydrophobic ionic liquid to the hydrophilic thermoplastic resin, however, the electrical resistance tends to increase with time through a durability test thereof although the environmental dependence of the electrical resistance is reduced. Such changes in electrical resistance with time caused when the electro-conductive belt is used for forming electrophotographic images are simply referred to as the changes in electrical resistance with time. In an ultimate analysis of the surface of the electro-conductive belt, a bleeding phenomenon was observed in which the hydrophobic ionic liquid migrated to the surface of the electro-conductive belt. It is assumed that the bleeding phenomenon of the hydrophobic ionic liquid causes the changes with time in the electrical resistance of the electro-conductive belt. For an electro-conductive resin layer formed of a composition prepared by adding a hydrophilic ionic liquid to the hydrophilic thermoplastic resin, on the other hand, the electrical resistance hardly exhibited the tendency to increase with time.

Figure 2:
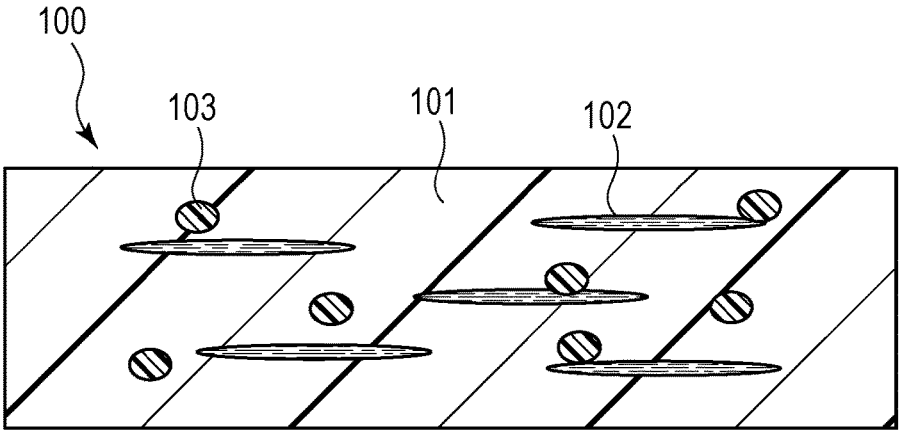
FIG. 2 is a schematic sectional view of an electro-conductive belt according to an embodiment of the application.

When the electro-conductive resin layer formed of a composition prepared by adding a hydrophobic ionic liquid to the hydrophilic thermoplastic resin was cut along the thickness direction thereof, the cross section of the resin layer had a matrix-domain structure in which domains 102 each containing the hydrophobic ionic liquid are scattered throughout a matrix 101 containing the hydrophilic thermoplastic resin, as shown in FIG. 2. Accordingly, the inventors have assumed that when a transfer electric field is applied to an electro-conductive belt including an electro-conductive resin layer made of a composition prepared by adding a hydrophobic ionic liquid to the hydrophilic thermoplastic resin, the ionic liquid bleeds from the domains 102 and migrates to the surface of the electro-conductive resin layer through the matrix 101, thereby causing electrical resistance to change with time. The present inventors therefore have expected that the migration through the matrix of the ionic liquid having bled from the domains can be suppressed by adding a substance capable of trapping the bled ionic liquid to the electro-conductive resin layer, and that the stability of electrical resistance with time thus can be further increased. According to such consideration, the present inventors added particles containing a silicone resin compatible with a hydrophobic ionic liquid to the electro-conductive resin layer containing the hydrophilic thermoplastic resin and a hydrophobic ionic liquid. The resulting electro-conductive belt exhibited reduced changes in electrical resistance with time. The application is based on such experimental results.

Electro-Conductive Belt

The electro-conductive belt according to an embodiment of the application will now be described in detail with reference to FIG. 2. The invention is however not limited to the disclosed embodiments.

The electro-conductive belt 100 includes an electro-conductive resin layer. The electro-conductive resin layer includes a matrix 101 containing a thermoplastic resin having an ester bond, a carbonate bond or an amide bond, and domains 102 each containing an ionic liquid containing a hexafluorophosphate anion or an anion expressed by the following formula (1), as mentioned above.

(1)

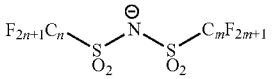

In formula (1), m and n each represent an integer of 1 to 4. The electro-conductive resin layer further includes particles 103 containing a silicone resin having a structure expressed by formula (2): $R_0$—$SiO_{3/2}$ (the particles are hereinafter referred to as silicone resin-containing particles). In formula (2), $R_0$ represents a hydrocarbon group having a carbon number of 1 to 6.

These materials will now be described.

Hydrophilic Thermoplastic Resin

A hydrophilic thermoplastic resin having at least one bond selected from the group consisting of an ester bond, a carbonate bond or an amide bond is used from the viewpoint of cost, workability and mechanical strength. In particular, a hydrophilic thermoplastic resin having a solubility parameter (SP value) of 10 or more is advantageous from the viewpoint of mechanical strength. More specifically, at least one of polyester, polycarbonate and polyamide is advantageously used. The matrix may further contain one or more of other resins, as long as the hydrophilicity of the matrix is not reduced.

Polyester

The polyester can be produced by polycondensation of a dicarboxylic acid and at least one of a dihydroxy component, an oxycarboxylic acid and a lactone. The polyester may have been copolymerized or modified. A poly(alkylene naphthalate) or a poly(alkylene terephthalate) is advantageous as the polyester in view of crystallinity and heat resistance. The alkylene of the poly(alkylene naphthalate) or poly(alkylene terephthalate) may have a carbon number in the range of 2 to 16, in view of crystallinity and heat resistance. Poly (ethylene naphthalate) and poly(ethylene terephthalate) are particularly advantageous.

The thermoplastic polyester may be a single polyester, or a mixture or an alloy of two or more polyesters. The poly(ethylene naphthalate) may be a commercially available product TN-8050SC (produced by Teijin Chemicals). The poly(ethylene terephthalate) may be a commercially available product TR-8550 (produced by Teijin Chemicals).

Polycarbonate

The polycarbonate can be produced by polycondensation of bisphenol A and phosgene or diphenyl carbonate, or of two or more of these materials. The polycarbonate may have been copolymerized or modified. The thermoplastic polycarbonate may be a single polycarbonate, or a mixture or an alloy of two or more polycarbonates. The polycarbonate may be a commercially available product TARFLON #2500 (produced by Idemitsu Kosan).

Polyamide

The polyamide can be produced by polycondensation of a dicarboxylic acid, a diamine, an aminocarboxylic acid, and a lactone, or of two or more of these materials. The polyamide may have been copolymerized or modified. Advantageously, the polyamide is at least one selected from the group consisting of polyamide 6, polyamide 66, polyamide 6T, polyamide 9T, polyamide 10T and polyamide MXD6, in view of crystallinity and heat resistance. The thermoplastic polyamide may be a single polyamide, or a mixture or an alloy of two or more polyamides. Commercially available UBE Nylon 1022B (produced by Ube Industries) is an example of polyamide 6. Polyamide MXD6 may be a commercially available product MX Nylon 6007 (produced by Mitsubishi Gas Chemical Company).

Ionic Liquid

The ionic liquid is a salt that is in a liquid form in a wide range of temperatures, and is particularly a salt having a melting point of 100° C. or less.

The ionic liquid used in the present embodiment has a highly hydrophobic anionic structure from the viewpoint of reducing the environmental dependence of the electrical resistance of the electro-conductive belt. The anion in the ionic liquid is hexafluorophosphate ($PF_6^-$) or an anion expressed by the following formula (1):

(1)

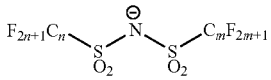

In formula (1), m and n each represents an integer of 1 to 4.

The cation counter to the hexafluorophosphate or the anion expressed by formula (1) is not particularly limited as long as it does not reduce the hydrophobicity of the ionic liquid. Examples of such a cation include quaternary ammonium ion, quaternary phosphonium ion, pyrrolidinium ion and derivative ions thereof, pyridinium ion and derivative ions thereof, and imidazolium ion and derivative ions thereof. In view of cost, the quaternary ammonium ion and the imidazolium ion are advantageous.

In an embodiment, the content of the ionic liquid in the electro-conductive resin layer of the electro-conductive belt may be 0.1% by mass or more relative to the total mass of the resin composition (total mass of the matrix, the silicone resin-containing particles, the ionic liquid and optionally added additives) used for forming the electro-conductive resin layer from the viewpoint of imparting a desired electrical resistance to the electro-conductive belt. Even if the ionic liquid content is more than 15% by mass, the electrical resistance does not decrease as expected. Accordingly, a preferable ionic liquid content is 15% by mass or less.

Silicone Resin-Containing Particles

The silicone resin contained in the silicone resin-containing particles used in the electro-conductive resin layer will now be described. The silicone resin contains a structural unit expressed by the following formula (2): $R_0$—$SiO_{3/2}$. In formula (2), $R_0$ represents a hydrocarbon group having a carbon number of 1 to 6.

The silicone resin containing the structural unit expressed by formula (2) may be a polymer formed by a combination of the structural unit of formula (2) and one or more of other structural units expressed by $SiO_{4/2}$, $(R_0)_2$—$SiO_{2/2}$ or $(R_0)_3$—$SiO_{1/2}$. Alternatively, the silicone resin may be a polymer formed by a combination of the structural unit of formula (2) and at least one structural unit selected from the group consisting of $(C_6H_5)R_0$—SiO, $(C_6H_5)_2SiO$ and $(R_0)_2$—SiO.

The silicone resin-containing particles may be produced by, but not limited to, hydrolyzing a hydrolyzable silane, forming cores by condensation of the hydrolyzation product, and growing the cores by further condensation.

The silicone-resin containing particles may be, for example, TOSPEARL (trade name, produced by Momentive Performance Materials).

The silicone resin-containing particles may have an average particle size in the range of 0.5 μm to 10 μm, from the viewpoint of efficiently trapping the ionic liquid having come into the matrix from the domains and keeping the surface of the electro-conductive belt smooth.

The average particle size of the silicone resin-containing particles can be estimated by measuring the shorter and longer axes of non-overlapping primary particles through a scanning electron microscope (SEM), and being calculated using the equation: (shorter axis+longer axis)/2. This operation is performed for randomly selected 20 particles. The arithmetically averaged value of the measured particle sizes is defined as the average particle size of the silicone resin-containing particles.

The amount of the silicone resin-containing particles is in the range of 10 parts by mass to 500 parts by mass, such as 30 parts by mass to 100 parts by mass, relative to 100 parts by mass of the ionic liquid, from the viewpoint of efficiently trapping the salt of the ionic liquid to suppress the changes in electrical resistance with time. The hydrophobicity of the silicone resin-containing particles depends on the structure of the "$R_0$" in formula (2). Accordingly, a hydrocarbon group having a carbon number of 1 to 6 is preferable as the "$R_0$". The hydrocarbon group may be linear, branched, or cyclic, and examples thereof include methyl (—$CH_3$), ethyl (—$CH_2CH_3$), propyl (—$CH_2CH_2CH_3$), butyl (—$CH_2CH_2CH_2CH_3$) and phenyl. The particles containing such a hydrophobic silicone resin is compatible with hydrophobic anions, particularly with the hexafluorophosphate ion and anions expressed by formula (1) having a plurality of perfluoroalkyl groups (—$C_nF_{2n+1}$, —$C_mF_{2m-1}$). Accordingly, it is expected that the ionic liquid having bled from the domains can be trapped with reliability.

Additives

The electro-conductive resin layer of the electro-conductive belt may contain other additives within a range in which the advantages of the invention are not reduced. Exemplary additives include an antioxidant, such as a hindered phenol-based antioxidant or a phosphorus or sulfur-based antioxidant, an ultraviolet absorbent, an organic pigment, an inorganic pigment, a pH adjuster, a crosslinking agent, a compatibilizing agent, a release agent, a coupling agent, a lubricant, an electro-conductive filler such as carbon black, carbon fiber, conductive titanium oxide, conductive tin oxide or conductive mica, and other ionic conducting agents. These additives may be used singly or in combination.

Electro-Conductive Belt

The electro-conductive belt includes an electro-conductive resin layer containing a thermoplastic resin having at least one bond selected from the group consisting of an ester bond, a carbonate bond and an amide bond, and an ionic liquid containing hexafluorophosphate or an anion expressed by formula (1), as described above.

The electro-conductive belt may has a structure in which the electro-conductive resin layer is in the form of an endless belt, or in which the electro-conductive resin layer is disposed on the outer surface of a substrate in the form of an endless belt. The electro-conductive belt including an endless belt-shaped electro-conductive resin layer is made of a resin composition prepared by melting and kneading the above-described thermoplastic resin and ionic liquid, and other constituents. The thermoplastic resin, which is hydrophilic, and the ionic liquid containing a specific hydrophobic anion are incompatible and difficult to mix well with each other. Accordingly, by melting and kneading the mixture of the hydrophilic thermoplastic resin and the hydrophobic ionic liquid, a composition is produced which has a microstructure including domains containing the ionic liquid and scattered in a matrix containing the hydrophilic thermoplastic resin.

The resin composition including the matrix and the domains is pelletized, and then formed into the shape of an endless belt by a known method, such as continuous melt extrusion, injection molding, stretch blow molding, or inflation molding. The electro-conductive belt of an embodiment including the electro-conductive resin layer thus can be produced.

For forming the resin composition into the shape of an endless belt, continuous melt extrusion or stretch blow molding is preferably employed. For the continuous melt extrusion, for example, an internal cooling mandrel method or a vacuum sizing method are advantageously applied, which are of downward extrusion enabling highly accurate control of the inner diameter of extruded tubes. The method for manufacturing the electro-conductive belt by stretch blow molding includes the following steps: forming a preform of the resin composition; heating the preform; placing the heated preform in a mold for forming an endless belt, and subsequently introducing a gas into the mold to perform stretch forming; and cutting the resulting stretch-formed product to yield an endless belt.

The electro-conductive resin layer may have a thickness of 40 μm to 500 μm, such as 50 μm to 120 μm. The electro-conductive resin layer may define the surface of the electro-conductive belt. Also, in order to improve the appearance of the electro-conductive belt or to make it easy to remove toner, the surface of the electro-conductive resin layer may be coated with a surface treating agent or subjected to surface treatment such as polishing. An outermost layer may be formed on the surface of the electro-conductive resin layer by applying a photo-curable resin and curing the resin, or by sputtering.

The electro-conductive belt of an embodiment of the present application is preferably used as, but not limited to, an intermediate transfer belt or a conveying transfer belt. The electro-conductive belt is more preferably used as an intermediate transfer belt. In the case where the electro-conductive belt is used as an intermediate transfer belt, the surface resistivity of the electro-conductive belt is preferably in the range of $1\times10^3$ Ω/sq. to $1\times10^{14}$ Ω/sq. The electro-conductive belt having a surface resistivity of $1\times10^3$ Ω/sq. or more prevents the significant decrease in resistance, and helps produce a required transfer electric field, thus preventing effectively the image from having ink missing or graininess. Also, the electro-conductive belt having a surface resistivity of $1\times10^{14}$ Ω/sq. or less keeps effectively the transfer voltage from increasing, thus suppressing the increase of the size of the power supply and cost effectively.

Electrophotographic Apparatus

Figure 1:
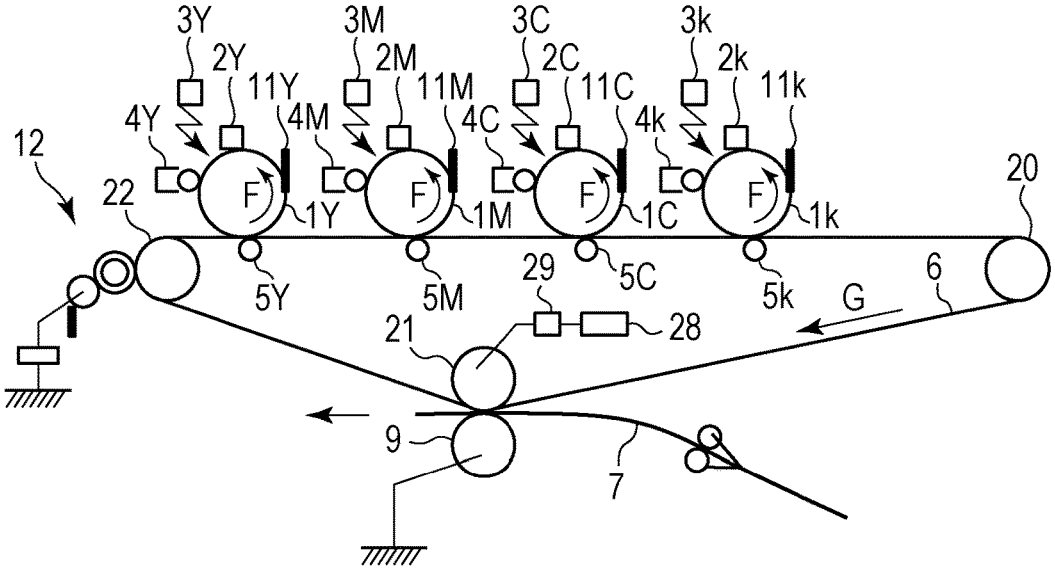
FIG. 1 is a schematic sectional view of an electrophotographic apparatus according to an embodiment of the application.

An electrophotographic apparatus will now be described which includes the electro-conductive belt of an embodiment of the application as the intermediate transfer belt. The electrophotographic apparatus has what is called a tandem structure in which electrophotographic stations for a plurality of colors are arranged along the rotation direction of the electro-conductive belt (hereinafter referred to as the intermediate transfer belt), as shown in FIG. 1. Although the components or members for the yellow, magenta, cyan and black colors will be described with reference numerals and letters Y, M, C and k, respectively, the letters may be omitted in other descriptions for similar components or members.

Referring to FIG. 1, photosensitive drums 1Y, 1M, 1C and 1*k* are provided therearound respectively with charging devices 2Y, 2M, 2C and 2*k*, exposure devices 3Y, 3M, 3C and 3*k*, and developing devices 4Y, 4M, 4C and 4*k*. Also, the intermediate transfer belt (intermediate transfer member) 6 lies adjacent to the photosensitive drums. Each photosensitive drum 1 is driven for rotation at a predetermined peripheral speed in the direction of arrow F. The charging device 2 charges the periphery of the photosensitive drum 1 to a predetermined potential with a predetermined polarity (primary charge). Laser beam scanners are used as the exposure devices 3. Each of the laser beam scanner emits a laser beam on/off-modulated according to image information input from an external apparatus (not shown) such as an image scanner or a computer, thus exposing the charged surface of the photosensitive drum 1 while scanning the charged surface. Thus, a desired electrostatic latent image according to the image information is formed on the surface of the photosensitive drum 1 by this exposure with scanning.

The developing devices 4Y, 4M, 4C and 4*k* contain yellow (Y), magenta (M), cyan (C) and black (k) toners, respectively. The developing devices 4 to be used are selected according to the image information and thus develop the electrostatic latent image into a visible toner image on the corresponding photosensitive drums 1. The apparatus described in the present embodiment uses a reversal development method in which toner particles are deposited on the exposed portion of the electrostatic latent image for development. The charging device, exposure device and developing device constitute an electrophotographic unit.

The intermediate transfer belt 6, which is an endless belt, is disposed so as to come in contact with the surfaces of the photosensitive drums 1, and is stretched with a plurality of stretching rollers 20, 21 and 22. The intermediate transfer belt is thus rotated in the direction of arrow G. In the present embodiment, stretching roller 20 is a tension roller that controls the intermediate transfer belt 6 to a constant tension; stretching roller 22 is a driving roller of the intermediate transfer belt 6; and stretching roller 21 is an opposing roller for secondary transfer. Primary transfer rollers 5Y, 5M, 5C and 5*k* are each arranged in a primary transfer position so as to oppose the corresponding photosensitive drum 1 with the intermediate transfer belt 6 therebetween.

The unfixed toner images having different colors on the photosensitive drums 1 are electrostatically primary-transferred to the intermediate transfer belt 6 one after another by applying a primary bias having a polarity opposite to the polarity of the toner to the primary transfer rollers 5 from a constant voltage source or a constant current source. Thus a full-color image including unfixed toner images having four different colors is formed on the intermediate transfer belt 6. The intermediate transfer belt 6 is rotated, bearing the toner images transferred from the photosensitive drums 1. For subsequent image forming operations, the surface of each photosensitive drum 1 is subjected to cleaning for removing remaining toner with a cleaning unit 11 after every one rotation.

At the secondary transfer position of the intermediate transfer belt 6, which faces the conveying path of the recording medium 7, a secondary transfer roller (transferring member) 9 is disposed so as to press the side of the intermediate transfer belt 6 bearing the toner image. An opposing roller 21 to which a bias is applied is disposed as an electrode opposing to the secondary transfer roller 9 on the rear side of the intermediate transfer belt 6 at the secondary transfer position. For transferring the toner image on the intermediate transfer belt 6 to the recording medium 7, a bias having the same polarity as the toner is applied to the opposing roller 21 from a transfer bias application device 28. For example, a voltage of −1000 V to −3000 V is applied to the opposing roller 21 and a current of −10 μA to −50 μA flows. This transfer voltage is detected with a transfer voltage detection device 29. Furthermore, a cleaning unit (belt cleaner) 12 is disposed downstream from the secondary transfer position to remove remaining toner from the intermediate transfer belt 6 after the secondary transfer.

The recording medium 7 fed to the secondary transfer position is pinched at the secondary transfer position. At this time, a constant bias (transfer bias) controlled to a predetermined voltage is applied to the opposing roller 21 opposing to the secondary transfer roller 9 from the secondary transfer bias application device 28. By applying a transfer voltage having the same polarity as the toner to the opposing roller 21, the full color image (toner image) formed on the intermediate transfer belt 6 by superimposing the four color images at the transfer position is transferred to the recording medium 7 at one time, thus forming an unfixed full color toner image on the recording medium 7. The recording medium 7 subjected to transfer of the toner image is fed to a fuser (not shown) and heated for fixing.

The electro-conductive belt according to an embodiment of the present application has an electrical resistance that is less dependent on environment and does not vary much even though a transfer electric field is applied thereto. Also, the electrophotographic apparatus according to another embodiment of the present application can stably form high-quality electrophotographic images.

The present application will be further described in detail with reference to Examples and Comparative Examples, but is not limited to the Examples. For the Examples and Comparative Examples, electro-conductive endless belts were produced.

Tables 1 to 4 show the materials (thermoplastic resins, conducting agents, electrolytes, and particles) used in the electro-conductive belts of Examples and Comparative Examples.

TABLE 1

| | |
|---|---|
| Thermoplastic resin 1 | Thermoplastic polyester resin<br>Poly(ethylene terephthalate) (PET)<br>(Product name: TR-8550, produced by Teijin Chemicals)<br>melting point (Tm) = 260° C. |

TABLE 1-continued

| | |
|---|---|
| Thermoplastic resin 2 | Thermoplastic polycarbonate resin<br>Polycarbonate (PC)<br>(Product name: TARFLON #2500, produced by Idemitsu Kosan)<br>melting point (Tm) = none, glass transition temperature (Tg) = 150° C. |
| Thermoplastic resin 3 | Thermoplastic polyamide resin<br>m-Xylene adipamide (MXD 6)<br>(Product name: MX Nylon 6007, produced by Mitsubishi Gas Chemical Company)<br>melting point (Tm) = 243° C. |

TABLE 2

| | |
|---|---|
| Ionic liquid 1 (hydrophobic) | 1-Butyl-3-methylimidazolium hexafluorophosphate (produced by Tokyo Chemical Industry) |
| Ionic liquid 2 (hydrophobic) | Tri-n-butylmethyl ammonium bis(trifluoromethane-sulfone)imide (produced by Sumitomo 3M) |
| Ionic liquid 3 (hydrophilic) | 1-Butyl-3-methylimidazolium trifluoromethanesulfonate (produced by Tokyo Chemical Industry) |
| Ionic conducting agent | Poly(ether amide)<br>(Product name: PELESTAT NC 6321, produced by Sanyo Chemical Industries) |

TABLE 3

| | |
|---|---|
| Electrolyte | Potassium nonafluorobutanesulfonate<br>(Product name: KFBS, produced by Mitsubishi Materials Electronic Chemicals) |

TABLE 4

| (Particles) | |
|---|---|
| Silicone resin particles 1 (hydrophobic) | Polymethylsilsesquioxane<br>(Product name: TOSPEARL 120, produced by Momentive Performance Materials)<br>Terminal group ($R_0$): methyl<br>Average particle size: 2 μm |
| Silicone resin particles 2 (hydrophobic) | Polyphenylsilsesquioxane (produced by Gelest)<br>Terminal group: ($R_0$): phenyl<br>Average particle size after mill pulverization: 2 μm |
| Acrylic resin particles (hydrophilic) | Cross-linked poly(methyl methacrylate)<br>(Product name: SSX-102, produced by Sekisui Plastics)<br>Terminal group: acrylic or methyl<br>Average particle size: 2 μm |
| Inorganic particles | Zeolite (Aluminosilicate)<br>(Product name: JC-20, produced by Mizusawa Industrial Chemicals)<br>Terminal group: none<br>Average particle size: 2 μm |

Example 1

A resin composition was prepared by hot-melt kneading of the materials shown in Table 5 with a twin-screw extruder TEX 30a (manufactured by Japan Steel Works). The hot-melt kneading was performed at a temperature controlled in the range of 260° C. to 280° C. for about 3 to 5 minutes. The resulting resin composition was formed into pellets, and the pellets were dried at 140° C. for 6 hours.

TABLE 5

| Material | Content (parts by mass) |
|---|---|
| Matrix resin 1 | 93 |
| Ionic liquid 1 | 5 |
| Silicone resin particles 1 | 2 |

Subsequently, the preform of the resin composition was formed with an injection molding apparatus SE 180D (manufactured by Sumitomo Heavy Industries) whose cylinder was set to 275° C. At this time, the injection mold was set to a temperature of 30° C. The preform was softened in a heating device of 500° C., and then heated at 500° C.

Then, the preform was introduced to a primary blow molding apparatus. The preform was formed into a blow bottle by blow molding in a blow mold in which the temperature is kept at 110° C., with a force of the drawing bar and air (at the air inlet for blowing) under the conditions of 120° C. in preform temperature, 0.3 MPa in air pressure, and 1000 mm/s in drawing bar speed. The resulting blow bottle was cut at both ends to yield an electro-conductive endless belt including an electro-conductive resin layer including a matrix containing a polyester and domains containing an ionic liquid. The resulting electro-conductive belt had a thickness of 70 μm.

Examples 2 to 7

Electro-conductive endless belts were produced in the same manner as in Example 1, except that the materials and the contents thereof were as shown in Table 6.

Example 8

Pellets were prepared in the same manner as in Example 1, except that the materials and the contents thereof were as shown in Table 6. The pellets were introduced into an extruder, conducted to annular dies, and then melt-extruded into a tube. The tube was cut to yield an electro-conductive endless belt.

Example 9

An electro-conductive endless belt was produced in the same manner as in Example 1, except that the materials and the contents thereof were as shown in Table 6 and the cylinder temperature of the injection molding apparatus and the blow temperature were set to 270° C. and 115° C., respectively.

TABLE 6

| | Example | | | | | | | | |
|---|---|---|---|---|---|---|---|---|---|
| | 1 | 2 | 3 | 4 | 5 | 6 | 7 | 8 | 9 |
| Thermoplastic resin 1 | 93 | 93 | 94 | 91 | 93 | 93 | 88 | — | — |
| Thermoplastic resin 2 | — | — | — | — | — | — | — | 93 | — |
| Thermoplastic resin 3 | — | — | — | — | — | — | — | — | 93 |
| Ionic liquid 1 (hydrophobic) | 5 | 5 | 5 | 5 | — | — | 10 | 5 | 5 |
| Ionic liquid 2 (hydrophobic) | — | — | — | — | 5 | 5 | — | — | — |
| Ionic liquid 3 (hydrophilic) | — | — | — | — | — | — | — | — | — |
| Silicone resin particles 1 (hydrophobic) | 2 | | 1 | 4 | 2 | — | 2 | 2 | 2 |
| Silicone resin particles 2 (hydrophobic) | — | 2 | — | — | — | 2 | — | — | — |

Unit: parts by mass

The electro-conductive endless belts of Examples 1 to 9 were evaluated as below.

Evaluation (1)

The electro-conductive belts of Examples 1 to 9 were allowed to stand in a high-temperature high-humidity environment (30° C., 80% RH) for 12 hours. Then, the surface resistances (ρs) were measured.

For measuring the surface resistances, a high resistivity meter HIRESTA-UP MCP-HT 450 (manufactured by Mitsubishi Chemical Analytech) was used. The main electrode of the resistivity meter had an inter diameter of 50 mm, and the guard ring electrode thereof has an inner diameter of 53.2 mm. Also, a probe UR-100 (manufactured by Mitsubishi Chemical Analytech) having an outer diameter of 57.2 mm was used.

The measurement was performed in accordance with JIS-K 6911. More specifically, surface resistivities (ρs) were measured at four points along the periphery of the electro-conductive belt while a voltage of 500 V was applied to the electro-conductive belt for 10 seconds. The measured values were averaged. The logarithm $\log_{10}\rho s$ of the average was calculated.

Subsequently, each electro-conductive belt was installed as the intermediate transfer belt to the transfer unit of a tandem full color electrophotographic apparatus LBP 7600C (manufactured by Canon) having a structure as shown in FIG. 1. The number of power sources of the transfer unit was reduced to one from the viewpoint of reducing the number of peripheral members around the unit for cost reduction, and the transfer unit was thus modified so that only a predetermined voltage could be applied as the transfer voltage.

The full color electrophotographic apparatus provided with the electro-conductive belt was set to a transfer voltage of 500 V so as to be able to form images having the best image quality even in high-temperature, high humidity environment. Thus, a full color image was output. The resulting image was visually checked for scattering of toner particles and a ghost image.

Evaluation (2)

After the full color electrophotographic apparatus used for the above evaluation (1) was allowed to stand in a low-temperature, low humidity (15° C., 10% RH) environment for 12 hours, the surface resistance of each electro-conductive belt was measured in this environment. Also, in the same environment, a full color image was output and subjected to evaluation in the same manner as evaluation (1). The transfer voltage for forming the full color image was set to the same voltage as in the above evaluation (1).

Evaluation (3)

After the full color electrophotographic apparatus used for the above evaluation (2) was allowed to stand in normal temperature, normal humidity (23° C., 50% RH) environment for 12 hours, the surface resistance of each electro-conductive belt was measured in this environment. Subsequently, in the same environment, 150,000 full color images were successively output (successive output). Hence, transfer voltage was continuously applied to the electro-conductive belts.

Subsequently, after the full color electrophotographic apparatus was allowed to stand in a low-temperature, low humidity (15° C., 10% RH) environment for 12 hours, the surface resistance of each electro-conductive belt was measured in this environment. Also, in the same environment, a full color image was output and subjected to evaluation in the same manner as evaluation (1).

Evaluation (4)

After the full color electrophotographic apparatus used for the above evaluation (3) was allowed to stand in a high-temperature, high-humidity (30° C., 80% RH) environment for 12 hours, the surface resistance of each electro-conductive belt was measured in this environment. Also, in the same environment, a full color image was output and subjected to evaluation in the same manner as evaluation (1).

For each electro-conductive belt, the largest difference in surface resistance among evaluations (1) to (4) was calculated. The result was used as an index of changes in electrical resistance depending on environment and continuous use. Table 7 shows the surface resistances in evaluations (1) to (4) and the largest difference in surface resistance among the evaluations (1) to (4).

In general, since the electrical resistance of electro-conductive belts decreases in high-temperature, high-humidity environment, the transfer voltage between the photosensitive member and the electro-conductive belt increases. This causes a ghost image to occur easily. In contrast, the electrical resistance of electro-conductive belts increases in low-temperature, low-humidity environment, and accordingly, the transfer voltage between the photosensitive member and the electro-conductive belt decreases. Consequently, the toner tends to be scattered by electric discharge. Accordingly, when none of the full color images output for evaluations (1) to (4) exhibited scattering of toner particles or a ghost image, the sample was rated as A; and when any of the full color images output for evaluations (1) to (4) exhibited scattering of toner particles or a ghost image, the sample was rated as B. The results of the rating are shown in Table 7.

TABLE 7

| Evaluation | Example 1 | 2 | 3 | 4 | 5 | 6 | 7 | 8 | 9 |
|---|---|---|---|---|---|---|---|---|---|
| (1) Surface resistance in initial high-temperature, high-humidity environment (Log10ρs) | 10.7 | 10.7 | 10.6 | 10.6 | 10.5 | 10.5 | 9.7 | 11.0 | 10.4 |
| (2) Surface resistance in initial low-temperature, low-humidity environment (Log10ρs) | 11.5 | 11.5 | 11.4 | 11.4 | 11.3 | 11.3 | 10.4 | 11.8 | 11.2 |
| (3) Surface resistance in low-temperature, low-humidity environment after continuous operation (Log10ρs) | 11.6 | 11.7 | 11.7 | 11.5 | 11.4 | 11.4 | 10.6 | 11.9 | 11.5 |
| (4) Surface resistance in high-temperature, high-humidity environment after continuous operation (Log10ρs) | 10.8 | 10.9 | 10.9 | 10.7 | 10.6 | 10.6 | 9.9 | 11.0 | 10.6 |
| Largest difference in surface resistance among evaluations (1) to (4) | 0.9 | 1.0 | 1.1 | 0.9 | 0.9 | 0.9 | 0.9 | 0.9 | 1.1 |
| Rating | A | A | A | A | A | A | A | A | A |

Comparative Examples 1 to 6

Electro-conductive endless belts were produced in the same manner as in Example 1, except that the materials and the contents thereof were as shown in Table 8.

Comparative Example 7

Pellets were prepared in the same manner as in Example 1, except that the materials and the contents thereof were as shown in Table 8. The pellets were introduced into an extruder, conducted to annular dies, and then melt-extruded into a tube. The tube was cut to yield an electro-conductive belt.

Comparative Example 8

An electro-conductive belt was produced in the same manner as in Example 1, except that the materials and the contents thereof were as shown in Table 8 and the cylinder temperature of the injection molding apparatus and the blow temperature were set to 270° C. and 115° C., respectively.

Comparative Examples 9 and 10

Electro-conductive belts were produced in the same manner as in Example 1, except that the materials and the contents thereof were as shown in Table 8.

Comparative Example 11

An electro-conductive belt was produced in the same manner as in Example 1, except that the resin composition was prepared according to Table 8.

The electro-conductive belts of Comparative Examples 1 to 11 were subjected to evaluations (1) to (4). The results are shown in Table 9.

TABLE 8

| | Comparative Example 1 | 2 | 3 | 4 | 5 | 6 | 7 | 8 | 9 | 10 | 11 |
|---|---|---|---|---|---|---|---|---|---|---|---|
| Thermoplastic resin 1 | 95 | 93 | 91 | 93 | 91 | 93 | — | — | 95 | 93 | 81 |
| Thermoplastic resin 2 | — | — | — | — | — | — | 93 | — | — | — | — |
| Thermoplastic resin 3 | — | — | — | — | — | — | — | 93 | — | — | — |
| Ionic conducting agent | — | — | — | — | — | — | — | — | — | — | 15 |
| Ionic liquid 1 (hydrophobic) | 5 | 5 | 5 | 5 | 5 | — | 5 | 5 | — | — | — |
| Ionic liquid 2 (hydrophobic) | — | — | — | — | — | 5 | — | — | — | — | — |
| Ionic liquid 3 (hydrophilic) | — | — | — | — | — | — | — | — | 5 | 5 | — |
| Electrolyte | — | — | — | — | — | — | — | — | — | — | 2 |
| Silicone resin particles 1 (hydrophobic) | — | — | — | — | — | — | — | — | — | 2 | 2 |
| Acrylic resin particles (hydrophilic) | — | 2 | 4 | — | — | 2 | 2 | 2 | — | — | — |
| Inorganic particles | — | — | — | 2 | 4 | — | — | — | — | — | — |

Unit: parts by mass

TABLE 9

| Evaluation | Comparative Example 1 | 2 | 3 | 4 | 5 | 6 | 7 | 8 | 9 | 10 | 11 |
|---|---|---|---|---|---|---|---|---|---|---|---|
| (1) Surface resistance in initial high-temperature, high-humidity environment (Log10ρs) | 10.7 | 10.8 | 10.7 | 10.7 | 10.7 | 10.7 | 11.0 | 10.1 | 10.2 | 10.0 | 9.9 |
| (2) Surface resistance in initial low-temperature, low-humidity environment (Log10ρs) | 11.5 | 11.6 | 11.5 | 11.5 | 11.6 | 11.5 | 11.8 | 11.1 | 11.7 | 11.6 | 11.7 |

TABLE 9-continued

| Evaluation | Comparative Example 1 | 2 | 3 | 4 | 5 | 6 | 7 | 8 | 9 | 10 | 11 |
|---|---|---|---|---|---|---|---|---|---|---|---|
| (3) Surface resistance in low-temperature, low-humidity environment after continuous operation (Log10ρs) | 12.1 | 12.2 | 12.1 | 12.1 | 12.2 | 12.1 | 12.4 | 11.7 | 11.8 | 11.7 | 12.2 |
| (4) Surface resistance in high-temperature, high-humidity environment after continuous operation (Log10ρs) | 11.2 | 11.3 | 11.2 | 11.2 | 11.3 | 11.2 | 11.6 | 10.7 | 10.3 | 10.1 | 10.4 |
| Largest difference in surface resistance among evaluations (1) to (4) | 1.4 | 1.4 | 1.4 | 1.4 | 1.5 | 1.4 | 1.4 | 1.6 | 1.6 | 1.7 | 2.3 |
| Rating | B | B | B | B | B | B | B | B | B | B | B |

In Comparative Example 1, as shown in Table 9, the surface resistance after the successive output in evaluation (3) was significantly increased from the surface resistance in evaluation (1). This is probably because, in the electro-conductive belt of Comparative Example 1, which did not contain silicone resin particles, continuous application of a transfer electric field for the successive output caused the ionic liquid to bleed from the domains and migrate to the surface of the electro-conductive belt. Also, as a result of this, the full color image outputted in evaluation (3) exhibited scattering of toner particles caused probably by electric discharge.

In Comparative Examples 2 to 6, as well as in Comparative Example 1, the full color image outputted in evaluation (3) exhibited scattering of toner particles caused probably by electric discharge. In Comparative Examples 2, 3 and 6, the particles added to the electro-conductive belt were hydrophilic and less compatible with the hydrophobic ionic liquid. It is assumed that continuous application of a transfer electric field consequently caused the ionic liquid to bleed from the domains and migrate to the surface of the electro-conductive belt without being trapped. In Comparative Examples 4 and 5, the inorganic particles added to the electro-conductive belt were also less compatible with the hydrophobic ionic liquid. It is assumed that continuous application of a transfer electric field consequently caused the ionic liquid to bleed from the domains and migrate to the surface of the electro-conductive belt without being trapped.

For the electro-conductive belt of Comparative Example 7, the full color image outputted in evaluation (3) exhibited scattering of toner particles caused probably by electric discharge.

For the electro-conductive belt of Comparative Example 8, similarly, the full color image outputted in evaluation (3) exhibited scattering of toner particles caused probably by electric discharge.

For the electro-conductive belts of Comparative Examples 9 and 10, the ionic liquid was hydrophilic and highly compatible with the hydrophilic thermoplastic resin in the matrix. Consequently, the surface resistance was kept from increasing even after successive output. The electrical conductivity however varied considerably depending on the surrounding environment because it was made conductive by the hydrophilic ionic liquid. Consequently, the surface resistance in evaluation (2) was increased from the surface resistance in evaluation (1). Also, as a result of this, the full color image outputted in evaluation (2) exhibited scattering of toner particles caused probably by electric discharge.

In Comparative Example 11, a poly(ether amide) and a fluorine-containing electrolyte were used as the conducting agent. The electrical resistance of the electro-conductive belt made conductive by these ionic conducting agents is liable to vary depending on the environment of use. The surface resistance in evaluation (2) was therefore increased from the surface resistance in evaluation (1). As a result of this, the full color image outputted in evaluation (2) exhibited scattering of toner particles caused probably by electric discharge. Also, continuous application of a transfer electric field caused the ionic conducting agent to gradually migrate with time and thus significantly increased the surface resistance in evaluation (3). As a result of this, the full color image outputted in evaluation (3) exhibited marked scattering of toner particles caused probably by electric discharge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-117845, filed on Jun. 6, 2014, which is hereby incorporated by reference herein in its entirety.

What is claimed is:

1. An electro-conductive belt, comprising:

an electro-conductive resin layer, the electro-conductive resin layer containing:

(1) a matrix containing a thermoplastic resin having at least one bond selected from the group consisting of an amide bond, an ester bond and a carbonate bond;

(2) particles; and (3) a domain containing an ionic liquid including a hexafluorophosphate anion or an anion expressed by the following formula (1):

(1)

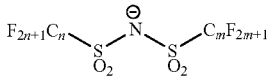

wherein m and n each represent an integer of 1 to 4, wherein the particles contain a silicone resin having a structural unit expressed by the following formula (2):

$R_0$—$SiO_{3/2}$, wherein $R_0$ represents a hydrocarbon group having a carbon number of 1 to 6, and wherein the amount of the particles is in the range of 30 to 100 parts by mass relative to 100 parts by mass of the ionic liquid.

2. The electro-conductive belt according to claim 1, wherein the thermoplastic resin has a solubility parameter of 10 or more.

3. The electro-conductive belt according to claim 1, wherein the thermoplastic resin contains at least one resin selected from the group consisting of polyester, polycarbonate, and polyamide.

4. The electro-conductive belt according to claim 1, wherein $R_0$ in formula (2) represents a methyl group or a phenyl group.

5. The electro-conductive belt according to claim 1, wherein the ionic liquid contains a quaternary ammonium ion or an imidazolium ion as a cation.

6. The electro-conductive belt according to claim 1, wherein the ionic liquid content in the electro-conductive resin layer is in the range of 0.1% by mass to 15% by mass relative to the total mass of the materials used for forming the electro-conductive resin layer.

7. The electro-conductive belt according to claim 3, wherein the polyester is at least one of poly(ethylene naphthalate) and poly(ethylene terephthalate).

8. An electrophotographic apparatus comprising:

the electro-conductive belt as set forth in claim 1 as an intermediate transfer belt.

* * * * *